US007937965B2

(12) United States Patent
Hering

(10) Patent No.: US 7,937,965 B2
(45) Date of Patent: May 10, 2011

(54) JEWELRY RING AND METHOD FOR THE PRODUCTION THEREOF

(75) Inventor: Thorsten Hering, Buchholz I.D. Nordheide (DE)

(73) Assignee: Montblanc-Simplo GmbH (DE)

( * ) Notice: Subject to any disclaimer, the term of this patent is extended or adjusted under 35 U.S.C. 154(b) by 675 days.

(21) Appl. No.: 11/920,181

(22) PCT Filed: Jun. 21, 2006

(86) PCT No.: PCT/EP2006/005977

§ 371 (c)(1),
(2), (4) Date: Nov. 9, 2007

(87) PCT Pub. No.: WO2007/003273

PCT Pub. Date: Jan. 11, 2007

(65) Prior Publication Data

US 2009/0084134 A1 Apr. 2, 2009

(30) Foreign Application Priority Data

Jun. 30, 2005 (DE) ..... 10 2005 030 570

(51) Int. Cl.
*A44C 9/00* (2006.01)

(52) U.S. Cl. ..... 63/15.1; 63/15.3; 63/15.4

(58) Field of Classification Search ..... None
See application file for complete search history.

(56) References Cited

U.S. PATENT DOCUMENTS

| | | | | |
|---|---|---|---|---|
| 1,712,417 | A * | 5/1929 | Beaujard, Jr. | 63/15.3 |
| 2,060,345 | A * | 11/1936 | Phillips | 63/3 |
| 4,187,697 | A | 2/1980 | Castelo | |
| 2001/0020369 | A1 | 9/2001 | Hirano | |

FOREIGN PATENT DOCUMENTS

| | | | |
|---|---|---|---|
| DE | 94 15 365.5 | U1 | 11/1994 |
| DE | 200 19 378 | U1 | 2/2001 |
| DE | 202 19 930 | U1 | 4/2003 |
| DE | 203 00 443 | U1 | 5/2003 |
| DE | 103 02 278 | A1 | 3/2004 |
| EP | 0 976 341 | B1 | 2/2000 |
| EP | 1 208 763 | A | 5/2002 |
| GB | 2 337 687 | A | 12/1999 |

* cited by examiner

*Primary Examiner* — Jack W. Lavinder
(74) *Attorney, Agent, or Firm* — Lerner, David, Littenberg, Krumholz & Mentlik, LLP

(57) ABSTRACT

The present invention generally relates to a jewelry ring (1) and a method for the production of such a jewelry ring (1). The jewelry ring consists of a first ring (2) having an inner surface area, a second ring (3) and a sliding ring (4), the latter is located between the first ring (2) and the second ring (3) to ease a preferably frictionless twistability of the two rings to each other.

26 Claims, 2 Drawing Sheets

JEWELRY RING AND METHOD FOR THE PRODUCTION THEREOF

TECHNICAL FIELD

The present invention generally relates to the technical field of jewelry production. In particular, the invention relates to a jewelry ring with a novel design and a method for the production of such a novel jewelry ring.

BACKGROUND OF THE INVENTION

Many ring wearers know the need or at least the habit to play with a ring they are wearing on one of their fingers, the ring being rotated about the finger or moved back and forth on the finger by the wearer. However, this need to play or need for distraction, which often arises out of boredom or nervousness, often, and preferably with rings of inferior material quality, results in both inner and outer circumference of the ring being subject to wear and possible coatings being removed.

Furthermore, for example rings are known which consist of several individual rings, each of which is intertwined, so that they can be pushed together onto a finger. These rings, which were brought on the market for the first time by the Cartier company under the name Cartier ring, also often invite the ring wearer to play since such a ring is easily moved back and forth in lengthwise direction of the finger due to its mechanical kinematic properties, which, in turn, however results in heavy signs of wear on the individual rings.

DESCRIPTION OF THE INVENTION

Due to the need to play or need for distraction of many ring wearers, and due to the wear and tear that is associated with it, there is a need for a ring which downright invites to play, however, without being subject to undesirable signs of wear in the process.

Therefore, the present invention is based on the idea to provide a ring comprising two separate individual rings that are fitted into one another in such a way that one ring is positioned concentrically with respect to the other ring, so that both rings can be rotated relative to each other. To prevent the occurrence of undesirable friction between the two rings during such a rotation, there is at least one sliding ring inserted between the two rings, which serves as bearing surface for at least one of the two rings, so it can be rotated, with respect to the respective other ring, around it without the occurrence of signs of wear and tear.

In particular, the ring according to the invention is a jewelry ring which comprises a first outer ring having an inner surface area, a second inner ring having an outer surface area, and at least one sliding ring which are arranged concentrically with respect to one another in such a way that the at least one sliding ring is located between the inner surface area of the first ring and the outer surface area of the second ring. By means of this concentric arrangement of the rings, it can be guaranteed that during a rotation, the second ring does not come into contact with the first ring, so that the signs of wear that usually result from the rotation can be avoided. In fact, the first ring slides along its inner surface area on the sliding ring, which due to the small coefficient of sliding friction between the at least one sliding ring and said first ring only results in microscopically small signs of wear. Instead of only the first ring sliding on the at least one sliding ring, naturally, it is also possible that both the first ring and the second ring are arranged slidingly with respect to the at least one sliding ring, or that only the second ring can perform a sliding movement relative to the at least one sliding ring.

Larger signs of wear between the first and second rings are effectively avoided by arranging the first ring around the second ring in such a way that the inner surface area of the first ring is opposite and spaced apart by the at least one sliding ring from the outer surface area of the second ring. By this, it can be guaranteed that an appropriate ring gap between the inner surface area of the first ring and the outer surface area of the second ring is always present, which prevents a rubbing together of the two rings. Indeed, the first ring also encloses the at least one sliding ring in such a way that a ring gap is created between the inner surface area of the first ring and the at least one sliding ring, but this ring gap is only about half the ring gap between the first and second rings, so that even in case of a tilting of the first and second rings they cannot come into contact with one another. In order to effectively avoid such a tilting and to improve the sliding process of the two rings with respect to each other, it can be advantageous, especially with wide rings, to insert more than only one sliding ring (for example two, three, or even more sliding rings) between the first and second rings, whereby an undesired tilting of the two rings is essentially avoided.

In order to be able to tightly mount the at least one sliding ring on the outer surface area of the second ring, the at least one sliding ring has an inner circumference that is designed as a cylindrical clamping surface. If a cylindrical clamping surface is mentioned here, it means the inner circumference of the sliding ring, by means of which the at least one sliding ring clamps onto the outer surface area of the second ring due to its elastic properties, provided the inside diameter of the at least one sliding ring is slightly smaller than the diameter of the outer surface area of the second ring, onto which it is to be mounted. In order to have only small friction losses while sliding the inner surface area of the first ring on the at least one sliding ring, the at least one sliding ring has opposite the cylindrical clamping surface an outer circumference that, in cross-section, is designed as convexly curved sliding surface. Besides the reduction of friction losses, this convexly curved form of the sliding surface of the at least one sliding ring additionally serves to secure the position of the first ring, which is explained in more detail later on in the present invention.

To secure the position of the first and second rings, the at least one sliding ring further essentially has two planar wall sections which radially extend between the cylindrical clamping surface and the convexly curved sliding surface. In case of a large axial stress on the two rings, these two planar wall sections rest against a recess formed in the second ring and in particular the walls thereof. Correspondingly, the inner surface area of the first ring also has at least one circular recess, into which the at least one sliding ring engages, so that a securing of the position in the axial direction is also guaranteed with regard to the first ring.

In order to optimize the friction conditions between the first ring and the sliding ring, the at least one recess in the inner surface area of the first ring is designed as concave sliding ring depression, into which the convexly curved sliding ring surface of the at least one sliding ring at least partially engages and locks in place, so that the convex curvature of the sliding ring surface of the at least one sliding ring continues outside the sliding ring depression in the inner surface area of the first ring.

In order to prevent that the at least one sliding ring comes off the outer surface area of the second ring or is removed in any other way while sliding the first ring onto the second ring during production of the jewelry ring, the at least one recess in the outer surface area of the second ring is designed as ring groove, into which the at least one sliding ring engages at least partially with its planar wall sections. Consequently, the cylindrical clamping surface of the at least one sliding ring is at the base of the ring groove of the second ring and the convexly curved sliding surface protrudes from the ring groove and encloses the outer surface area of the second ring.

In order to permanently guarantee these geometric relationships of the individual rings with respect to each other, the ring groove exhibits a radial depth dimension which is less than the radial thickness dimension of the at least one sliding ring, measured between the cylindrical clamping surface and the outermost point of the convexly curved sliding surface of the sliding ring. As explained in more detail later on, during production of the jewelry ring, the first ring is slid onto the second ring, however, in the process, the at least one sliding ring has to be slightly compressed in the radial direction until it can expand into the concave recess of the inner surface area of the first ring. In order to allow this radial compression of the at least one sliding ring, the ring groove exhibits a trapezoidal form that widens in the direction of the outer surface area of the second ring, resulting in the at least one sliding ring being able to expand sideways in it under radial stress. In particular, the trapezoidal form of the ring groove widens radially outward with respect to the planar wall sections of the sliding ring, so that said ring can expand with low strain in the ring groove.

In order to keep friction losses between the at least one sliding ring and the first ring as small as possible, for the at least one sliding ring a material should be selected where the coefficient of sliding friction between the at least one sliding ring and the first ring is as small as possible. In particular, the coefficient of sliding friction should be less than 0.05. Such a low coefficient of sliding friction can in particular be guaranteed if the at least one sliding ring is made of Teflon® (PTFE). To make the at least one sliding ring out of Teflon® additionally entails the further advantageous effect that in this case, the jewelry ring according to the invention can also be subjected to aggressive environmental conditions, such as for example salt water, certain acids and bases, since, as a rule, Teflon® is resistant with regard to such an attack. A further advantage that making the sliding ring out of Teflon® entails is that Teflon® possesses a self-lubricating property, so that the sliding joint between the sliding ring and the first ring does not have to be lubricated.

Since, circumferentially, the at least one sliding ring radially protrudes from the outer surface area of the second ring with its convex sliding surface, so that the first ring has to be pressed onto it and thereby experiences a radial strain, both the first ring and the second ring should be made of a metal that is essentially insensitive to such stresses. In particular, it would be advantageous to make the first and/or second ring of a metal from the group of metals consisting of gold, silver, platinum, titanium, brass, and Nirosta steel.

In order to allow for the sliding into one another of the first and second rings without damaging the sliding ring in the process, at least one front end of the first ring, a radius is formed which extends at the transition of the inner surface area to the front end of the first ring. The conically widening phase-like radius serves to ride in such a way onto the projecting part of the at least one sliding ring over the outer surface area of the second ring while sliding the first ring onto the second ring that the sliding ring is radially compressed in order to facilitate the nesting of the two rings.

In accordance with another aspect of the present invention, a method for the production of a jewelry ring comprising a first ring having an inner surface area, a second ring having an outer surface area, and at least one sliding ring is proposed. In order to be able to arrange these three individual components concentrically with respect to each other, so that the at least one sliding ring is located between the inner surface area of the first ring and the outer surface area of the second ring, first, the at least one sliding ring is mounted on the outer surface area of the second ring in order to be able to subsequently slide the first ring onto the second ring provided with the at least one sliding ring.

Since according to a preferred embodiment the at least one sliding ring is made of Teflon® (PTFE) and, consequently, can only be subjected to minor stretching, the at least one sliding ring is slit open in at least one place prior to mounting in order to thereby facilitate the mounting of it on the second ring.

In order to guarantee a securing of the position between the first and second rings, prior to mounting of the at least one sliding ring, both in the inner surface area of the first ring and in the outer surface area of the second ring at least one circular recess each is formed, into each of which the at least one sliding ring partially engages. These recesses are therefore designed in such a way that the at least one sliding ring is essentially entirely circumferentially accommodated, so that axial movements of the two rings with respect to one another are essentially eliminated.

As has become apparent from the previous explanations, the at least one sliding ring slightly protrudes with its external, circumferential convex sliding surface from the outer surface area of the second ring, which makes the sliding of the first ring onto the second ring more difficult. However, in order to neither damage the at least one sliding ring nor run the risk of pushing said ring out of the ring groove in the outer surface area of the second ring while sliding the first ring onto the second ring, prior to mounting the at least one sliding ring, the first ring is chamfered at least one front end in the area of its transition to the inner surface area in such a way that the radius formed circumferentially rides onto the at least one sliding ring while sliding the second and first rings into each other, so that said sliding ring is radially compressed.

BRIEF DESCRIPTION OF THE DRAWINGS

In the following, the present invention is explained in more detail with reference to two purely exemplary embodiments which are explained in more detail with reference to the following drawings.

In both figures, the same or similar components are labeled with identical reference numerals.

DESCRIPTION OF THE EXEMPLARY EMBODIMENTS OF THE INVENTION

Figure 1:
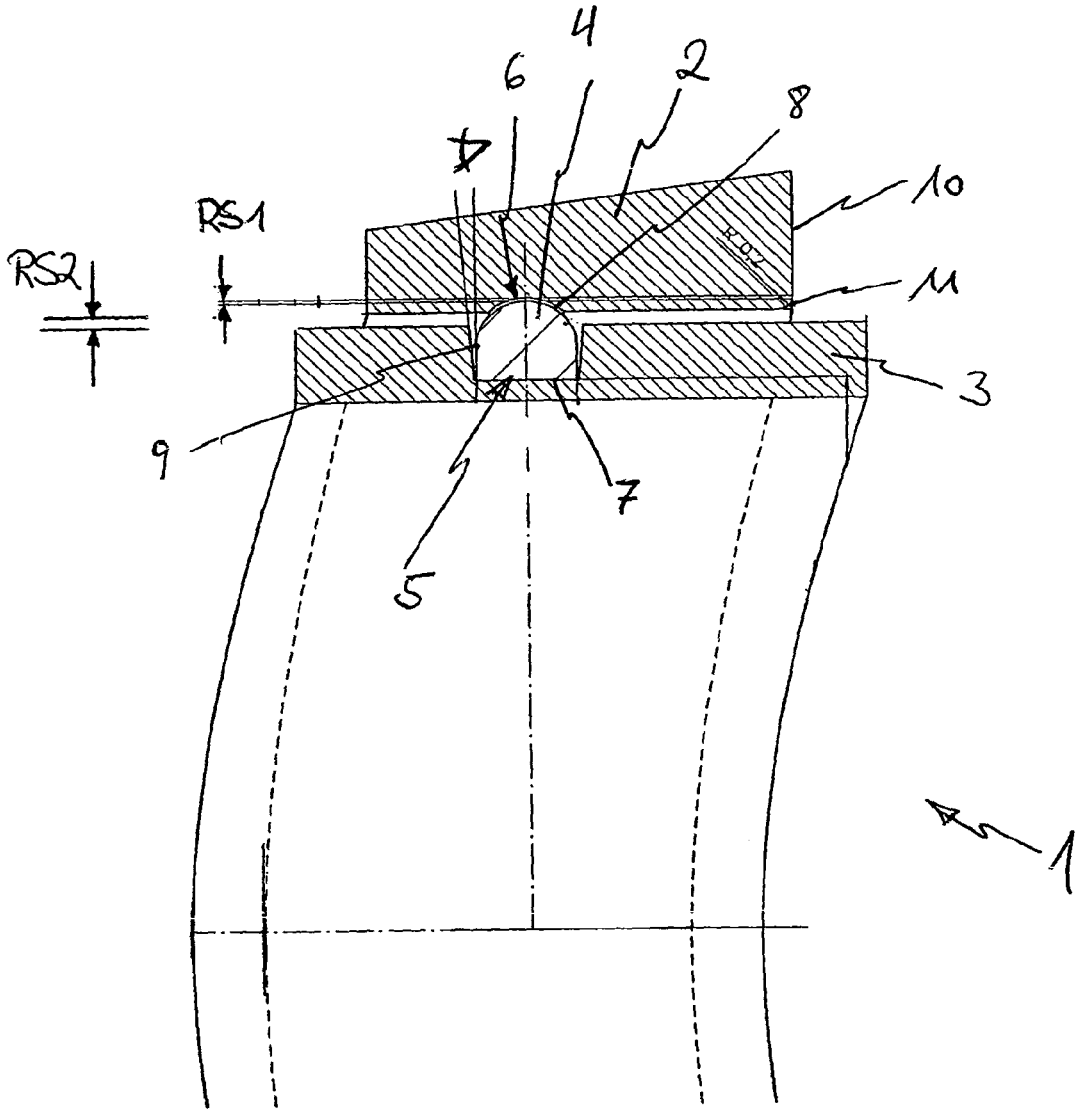
FIG. 1 shows a cross-section of the upper half of a narrow ring according to the invention having a sliding ring.

The jewelry ring 1 depicted in cross-section in FIG. 1 essentially comprises a first ring 2, a second ring 3, and a sliding ring 4. First ring 2, second ring 3, and sliding ring 4 are arranged concentrically with respect to each other in such a way that first ring 2 circumferentially encloses second ring 3 and sliding ring 4. Sliding ring 4, in turn, circumferentially encloses second ring 3, so that sliding ring 4 is located between the inner surface area of first ring 2 and the outer surface area of second ring 3. If viewed in cross-section, sliding ring 4 has a cylindrical clamping surface 7 which, in the fitted state, points toward the center of jewelry ring 1.

From clamping surface 7, two essentially planar wall sections 9 radially extend outward, which are followed by a convexly curved sliding surface 8, so that the sliding ring 4 has a virtually tunnel-shaped cross-section. To enable first ring 2 to slide on the convex sliding surface of sliding ring 4 with friction losses that are as small as possible, sliding ring 4 consists of a sliding material with only a very small coefficient of sliding friction with respect to first ring 2, for which reason sliding ring 4 is preferably made of Teflon® (PTFE).

The first ring 2 has in its inner surface area a circular recess which in the example shown here is designed as concavely curved sliding ring depression 6. On its right front side 10 or in the transition area between the right front side 10 to the inner surface area of first ring 2, first ring 2 has a circular, phased section 11. In other words, the transition area between the right front side 10 and the inner surface area is chamfered, as indicated by the radius arrow (R 0.2). The advantageous effect of this chamfered circular section 11 is explained in more detail later on in connection with the assembly of the ring.

The second ring 3 also has a recess in its outer surface area which, however, is designed as trapezoidal ring groove 5, the lateral wall areas of which radially widen outwards.

Both the first ring 2 and the second ring 3 are made of a metal such as for example silver, white or yellow gold (750 karat), platinum, titanium, brass, or Nirosta steel.

Preferably, both rings 2, 3 are made of one and the same material, however, naturally special aesthetic effects may also occur if the two rings 2, 3 are made of different materials.

As can be seen in FIG. 1, the two rings 2, 3 are hollow cylindrical bodies, the front surfaces of which, however, do not end flat but rather describe a wave form, which may lead to especially aesthetic effects if first ring 2 is rotated with respect to second ring 3.

Sliding ring 4 is inserted between the two rings 2, 3, so that the two rings 2, 3 do not rub against each other in case of a rotation. Sliding ring 4 is wedged in the trapezoidal ring groove 5 in such a way that the clamping surface 7 of sliding ring 4 clamps against the ring groove base of ring groove 5. The planar wall sections of sliding ring 4 extend in ring groove 5, the wall areas of trapezoidal ring groove 5 departing radially outward from the planar wall sections 9. Sliding ring 4 protrudes with its exterior circumference in form of the convexly curved sliding surface 8 from ring groove 5 of second ring 3 and dips with a section of the convexly curved sliding surface 8 in the sliding ring depression 6 of the first ring.

As can be seen from FIG. 1, a curved ring gap RS1 extends between the convexly curved sliding surface 8 of sliding ring 4 and the sliding ring depression 6, so that the first ring 2 can easily be rotated with respect to sliding ring 4 or second ring 3. The measurements of rings 2, 3, 4 are dimensioned in such a way that a ring gap RS2 also results between first ring 2 and second ring 3, so that in case of a rotation, first ring 2 and second ring 3 cannot come into contact with one another. The dimensions of rings 2, 3, 4 are dimensioned in such a way that ring gap RS1 is smaller than ring gap RS2. Preferably, ring gap RS1 has an inner width of 0.1 mm and ring gap RS2 has an inner width of 0.2 mm.

Since sliding ring 4 is made of a relatively low stretch material, such as for example Teflon® (PTFE), for mounting, sliding ring 4 is slit open in at least one place, so that the sliding ring 4 can be bent up slightly in order to subsequently be fitted into the ring groove 5. Since the radial thickness dimension of sliding ring 4 is larger than the radial depth dimension of ring groove 5, sliding ring 4 protrudes from ring groove 5, so that during assembly of jewelry ring 1, sliding ring 4 needs to be compressed in the radial direction to allow first ring 2 to be slid on. In order to facilitate such a compressing of sliding ring 4 in the radial direction, first ring 2 is provided with the circular radius 11 at the transition between the inner surface area and the right front end 10 described previously, so that during the sliding on of first ring 2, radius 11 rides onto the convexly curved sliding surface 8 of sliding ring 4 in such a way that said sliding ring is radially compressed by means of the wedging action of radius 11. Since sliding ring 4 naturally has to give way in another direction during such a radial compression, the trapezoidal ring groove 5 widens linearly with respect to the planar wall sections 9 of sliding ring 4, as is indicated by the angle symbol. That way, in case of radial compression, sliding ring 4 can give way sideways into these wedge-shaped areas, whereby first ring 2 can easily be slid onto second ring 3 that is provided with sliding ring 4.

Figure 2:
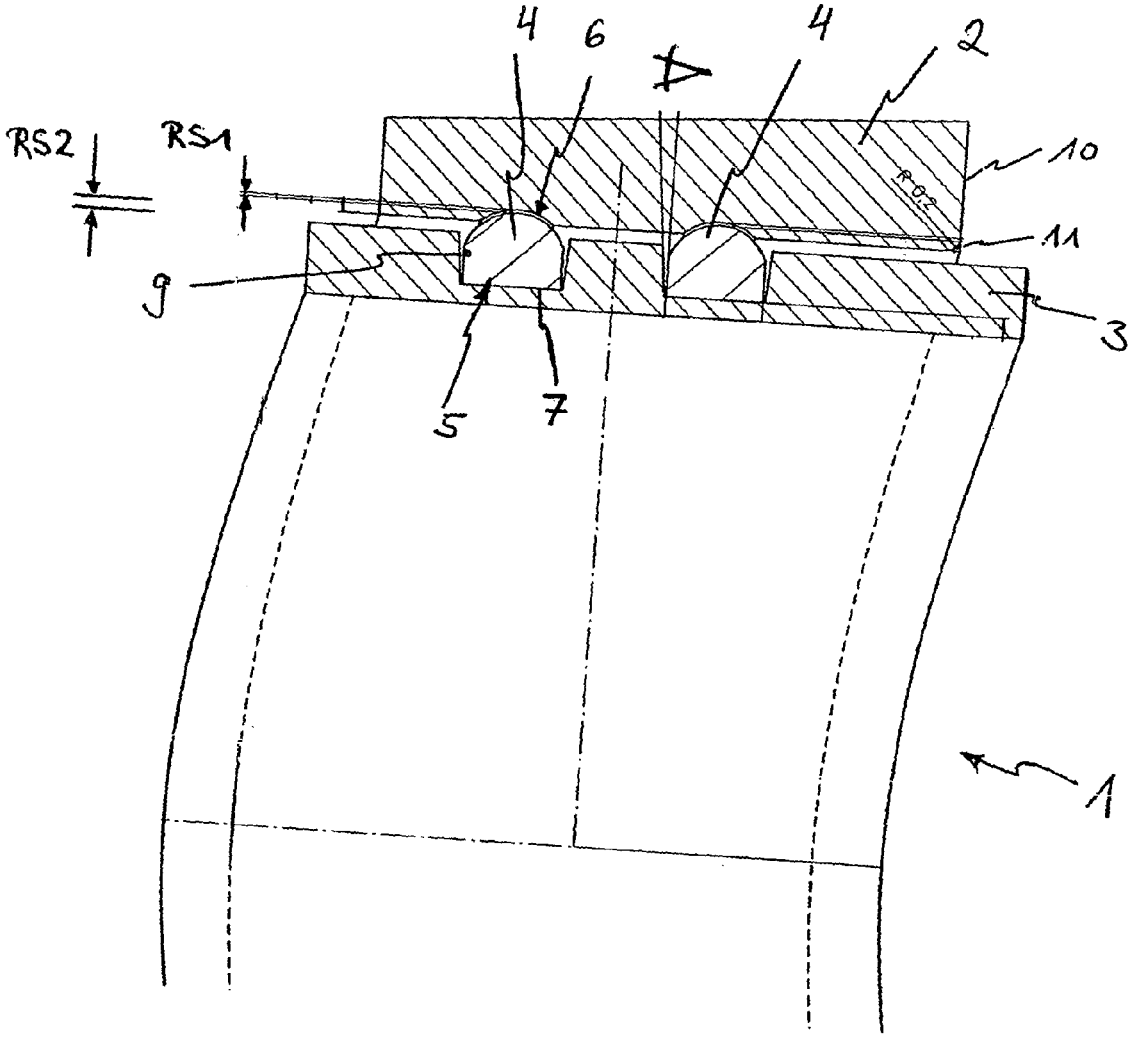
FIG. 2 shows a cross-section of the upper half of a wide ring according to the invention having two sliding rings.

In FIG. 2, a jewelry ring 1 is depicted that in its structural makeup essentially equals the jewelry ring 1 described with reference to FIG. 1. However, differing from FIG. 1, jewelry ring 1 depicted in FIG. 2 has a larger width, for which reason two sliding rings 4, that are spaced apart from each other, are inserted between first ring 2 and second ring 3 here, whereby a tilting of first ring 2 with respect to second ring 3 is to be avoided. Since in the embodiment shown in FIG. 2, the positioning of the second sliding ring 4 is identical with respect to the formation of ring groove 5 and sliding ring depression 6, at this point, it is simply referred to the explanations given previously.

As an alternative to the wide jewelry ring depicted in FIG. 2, it would for example be possible to design first ring 2 with two parts in form of two narrower rings instead of providing one wide first ring, so that these two narrower rings can be rotated around the second ring independently of each other.

REFERENCE NUMBER LIST

1 Jewelry ring
2 First ring
3 Second ring
4 Sliding ring
5 Ring groove
6 Sliding ring depression (concavely curved)
7 Clamping surface
8 Sliding surface (convexly curved)
9 Wall section (planar)
10 Front end
11 Radius
RS1 Ring gap sliding ring—first ring
RS2 Ring gap first ring—second ring

The invention claimed is:

1. A jewelry ring comprising
a first ring having an inner surface area;
a second ring having an outer surface area; and
at least one sliding ring,
said first ring, said second ring, and said at least one sliding ring being concentrically arranged with respect to one another in such a way that said at least one sliding ring is located between the inner surface area of first ring and the outer surface area of second ring, wherein when the first ring is rotated relative to the second ring, the first ring and second ring do not come into contact with one another.

2. A jewelry ring according to claim 1, wherein the first ring (2) is arranged around the second ring in such a way that the inner surface area of first ring is opposite and spaced apart by the at least one sliding ring from the outer surface area of second ring.

3. A jewelry ring according to claim 1, wherein at least the first ring slides along its inner surface area on the at least one sliding ring.

4. The jewelry ring of claim 3, wherein the second ring slides along the at least one sliding ring.

5. A jewelry ring according to claim 1, wherein the at least one sliding ring has an inner circumference that is designed as cylindrical clamping surface, and wherein the at least one sliding ring has opposite the cylindrical clamping surface an outer circumference that is designed as convexly curved sliding surface.

6. A jewelry ring according to claim 5, wherein the at least one sliding ring further comprises two essentially planar wall sections which radially extend between cylindrical clamping surface and convexly curved sliding surface.

7. A jewelry ring according to claim 1, wherein both in the inner surface area of first ring and in the outer surface area of second ring, at least one circular recess each is formed, into which the at least one sliding ring engages.

8. A jewelry ring according to claim 7, wherein the at least one recess in the inner surface area of first ring is designed as concave sliding ring depression, into which the convexly curved sliding surface of the at least one sliding ring at least partially engages.

9. A jewelry ring according to claim 7, wherein the at least one recess in the outer surface area of second ring is designed as ring groove, into which the at least one sliding ring at least partially engages with its planar wall sections.

10. A jewelry ring according to claim 9, wherein the at least one sliding ring is clamped into ring groove with its cylindrical clamping surface and protrudes from ring groove with its curved sliding surface.

11. A jewelry ring according to claim 9, wherein the ring groove has a radial depth dimension and the at least one sliding ring has a radial thickness dimension that is larger than the radial depth dimension of ring groove, so that the at least one sliding ring protrudes from ring groove.

12. A jewelry ring according to claim 9, wherein the ring groove has a trapezoidal shape that widens in the direction of the outer surface area of second ring.

13. A jewelry ring according to claim 9, wherein the trapezoidal shape of ring groove radially widens outward with respect to the planar wall sections of the at least one sliding ring.

14. A jewelry ring according to claim 13, wherein the widening is designed in such a way that, in case of radial stress, sliding ring can expand therein.

15. A jewelry ring according to claim 1, wherein the coefficient of sliding friction between the at least one sliding ring and first ring is less than 0.05.

16. A jewelry ring according to claim 1, wherein the at least one sliding ring is made of Polytetrafluorethylen (PTFE).

17. A jewelry ring according to claim 1, wherein at least one of first ring and second ring is made of a metal from the group of metals comprising silver, gold, platinum, titanium, brass, and stainless steel.

18. A jewelry ring according to claim 1, wherein the first ring has a front end that is chamfered at its transition to the inner surface area.

19. The jewelry ring of claim 1, wherein the second ring is rotatable relative to the at least one sliding ring.

20. The jewelry ring of claim 19, wherein the first ring is rotatable relative to the at least one sliding ring.

21. The jewelry ring of claim 1, wherein the first and second rings each have a recess for receiving the at least one sliding ring.

22. A method for the production of a jewelry ring comprising a first ring having an inner surface area, a second ring having an outer surface area, and at least one sliding ring that comprises the steps of:

mounting the at least one sliding ring on the outer surface area of second ring;

sliding into each other of second ring that is provided with the at least one sliding ring and first ring in such a way that the at least one sliding ring is located between the inner surface area of first ring and the outer surface area of second ring, wherein when the first ring is rotated relative to the second ring, the first ring and second ring do not come into contact with one another.

23. A production method according to claim 22, wherein prior to mounting, the at least one sliding ring is slit open in at least one place in order to be easily mounted on the second ring.

24. A production method according to claim 22, wherein prior to mounting of the at least one sliding ring, both in the inner surface area of first ring and in the outer surface area of second ring at least one circular recess each is formed, into each of which the at least one sliding ring partially engages.

25. A production method according to claim 24, wherein the circular recess of second ring is designed with a trapezoidal shape that widens outward, so that sliding ring can expand therein in case of radial stress.

26. A production method according to claim 22, wherein prior to mounting of the at least one sliding ring, first ring is chamfered at least one front end in the area of its transition to the inner surface area in such a way that, during the sliding into each other of second ring and first ring, the radius formed circumferentially rides onto the at least one sliding ring and radially compresses said sliding ring.

* * * * *